US011662148B2

(12) United States Patent
Ishibashi et al.

(10) Patent No.: US 11,662,148 B2
(45) Date of Patent: May 30, 2023

(54) HEAT EXCHANGER AND REFRIGERATION CYCLE APPARATUS

(71) Applicants: Mitsubishi Electric Corporation, Tokyo (JP); The University of Tokyo, Tokyo (JP)

(72) Inventors: Akira Ishibashi, Tokyo (JP); Tsuyoshi Maeda, Tokyo (JP); Shinya Higashiiue, Tokyo (JP); Daisuke Ito, Tokyo (JP); Shin Nakamura, Tokyo (JP); Ryota Akaiwa, Tokyo (JP); Akira Yatsuyanagi, Tokyo (JP); Ryuichi Nagata, Tokyo (JP); Eiji Hihara, Tokyo (JP); Chaobin Dang, Tokyo (JP); Jiyang Li, Tokyo (JP)

(73) Assignees: Mitsubishi Electric Corporation, Tokyo (JP); The University of Tokyo, Tokyo (JP)

( * ) Notice: Subject to any disclaimer, the term of this patent is extended or adjusted under 35 U.S.C. 154(b) by 79 days.

(21) Appl. No.: 16/627,404

(22) PCT Filed: Aug. 3, 2017

(86) PCT No.: PCT/JP2017/028253
§ 371 (c)(1),
(2) Date: Dec. 30, 2019

(87) PCT Pub. No.: WO2019/026239
PCT Pub. Date: Feb. 7, 2019

(65) Prior Publication Data

US 2020/0149818 A1 May 14, 2020

(51) Int. Cl.
*F28D 1/053* (2006.01)
*F28F 1/06* (2006.01)
(Continued)

(52) U.S. Cl.
CPC ..... *F28D 1/024* (2013.01); *F25B 39/04* (2013.01); *F28D 1/0316* (2013.01);
(Continued)

(58) Field of Classification Search
CPC ..... F28F 1/06; F28F 1/126; F28D 1/05366
See application file for complete search history.

(56) References Cited

U.S. PATENT DOCUMENTS 2,924,437 A * 2/1960 Wilkins ..... F28F 3/14 165/148
3,132,230 A * 5/1964 Laug ..... F24H 3/002 165/183
3,648,768 A * 3/1972 Scholl ..... F28F 9/04 165/172

(Continued)

FOREIGN PATENT DOCUMENTS

DE 3813339 A1 11/1989
EP 1248063 A1 10/2002

(Continued)

OTHER PUBLICATIONS

International Search Report of the International Searching Authority dated Oct. 24, 2017 for the corresponding international application No. PCT/JP2017/028253(and English translation).

*Primary Examiner* — Leonard R Leo
(74) *Attorney, Agent, or Firm* — Posz Law Group, PLC

(57) ABSTRACT

In a heat exchanger, each of a plurality of heat exchange members includes: a flat pipe; and a heat transfer plate integrated with the flat pipe along a longitudinal direction of the flat pipe. A width direction of each of the flat pipes intersects with a direction in which the plurality of heat exchange members are arranged side by side. Each of the heat transfer plates includes an extending portion extending outward in the width direction of each of the flat pipes from at least one of one end of a corresponding one of the flat
(Continued)

pipes in the width direction and another end of the corresponding one of the flat pipes in the width direction. Each of the flat pipes has one or more flat pipe bent portions, each forming a groove extending along the longitudinal direction of the flat pipes.

5 Claims, 5 Drawing Sheets

(51) Int. Cl.

| | |
|---|---|
| ***F28F 1/12*** | (2006.01) |
| ***F28D 1/02*** | (2006.01) |
| ***F25B 39/04*** | (2006.01) |
| ***F28D 1/03*** | (2006.01) |

(52) U.S. Cl.
CPC ..... *F28D 1/05366* (2013.01); *F28F 1/06* (2013.01); *F28F 1/126* (2013.01)

(56) References Cited

U.S. PATENT DOCUMENTS

| | | | | |
|---|---|---|---|---|
| 3,810,509 | A * | 5/1974 | Kun | F28D 9/00 165/148 |
| 6,918,435 | B2 * | 7/2005 | Dwyer | F28D 1/05333 29/890.047 |
| 2014/0231056 | A1 * | 8/2014 | Covington | B23P 15/26 29/890.038 |

FOREIGN PATENT DOCUMENTS

| | | | |
|---|---|---|---|
| JP | S53-78948 | A | 7/1978 |
| JP | H3-96574 | U | 10/1991 |
| JP | H05-060481 | A | 3/1993 |
| JP | 2002-153931 | A | 5/2002 |
| JP | 2004-177082 | A | 6/2004 |
| JP | 2006-084078 | A | 3/2006 |
| JP | 2006-284123 | A | 10/2006 |
| JP | 2008-202896 | A | 9/2008 |
| WO | 2002/016834 | A2 | 2/2002 |

* cited by examiner

HEAT EXCHANGER AND REFRIGERATION CYCLE APPARATUS

CROSS REFERENCE TO RELATED APPLICATION

This application is a U.S. national stage application of PCT/JP2017/028253 filed on Aug. 3, 2017, the disclosure of which is incorporated herein by reference.

TECHNICAL FIELD

The present invention relates to a heat exchanger including a plurality of flat pipes, and a refrigeration cycle apparatus including the heat exchanger.

BACKGROUND ART

There has hitherto been known a heat exchanger including a plurality of heat transfer pipe units, each including a refrigerant flow passage and heat transfer fin. The refrigerant flow passage and the heat transfer fins are formed by affixing two plates, each having a groove formed thereon, to each other (see, for example, Patent Literature 1).

CITATION LIST

Patent Literature

[PTL 1] JP 2006-84078 A

SUMMARY OF INVENTION

Technical Problem

In the related-art heat exchanger disclosed in Patent Literature 1, however, the heat transfer pipe units are liable to be affected by a force in a thickness direction of each of the heat transfer fins. Thus, the heat transfer pipe units are liable to be bent, with the result that a longer life of the heat exchanger cannot be achieved.

The present invention has been made to solve the problem described above, and has an object to provide a heat exchanger and a refrigeration cycle apparatus, with which strength of heat exchange members can be increased.

Solution to Problem

According to one embodiment of the present invention, there is provided a heat exchanger, including: a first header tank; a second header tank arranged so as to be apart from the first header tank; and a plurality of heat exchange members, which are each coupled to the first header tank and the second header tank, and are arranged side by side between the first header tank and the second header tank, wherein each of the plurality of heat exchange members includes: a flat pipe extending from the first header tank to the second header tank; and a heat transfer plate integrated with the flat pipe along a longitudinal direction of the flat pipe, wherein a width direction of each of the flat pipes intersects with a direction in which the plurality of heat exchange members are arranged side by side, wherein each of the heat transfer plates includes an extending portion extending outward in the width direction of each of the flat pipes from at least one of one end of a corresponding one of the flat pipes in the width direction and another end of the corresponding one of the flat pipes in the width direction, and wherein each of the flat pipes has one or more flat pipe bent portions, each forming a groove extending along the longitudinal direction of the flat pipes.

Further, according to one embodiment of the present invention, there is provided a heat exchanger, including: a first header tank; a second header tank arranged so as to be apart from the first header tank; and a plurality of heat exchange members, which are each coupled to the first header tank and the second header tank, and are arranged side by side between the first header tank and the second header tank, wherein each of the plurality of heat exchange members includes: a flat pipe extending from the first header tank to the second header tank; and a heat transfer plate integrated with the flat pipe along a longitudinal direction of the flat pipe, wherein a width direction of each of the flat pipes intersects with a direction in which the plurality of heat exchange members are arranged side by side, wherein each of the heat transfer plates includes an extending portion extending outward in the width direction of each of the flat pipes from at least one of one end of a corresponding one of the flat pipes in the width direction and another end of the corresponding one of the flat pipes in the width direction, wherein each of the extending portions has one or more heat transfer plate bent portions, each forming a groove along the longitudinal direction of the flat pipes, and wherein the plurality of heat exchange members are arranged so that the longitudinal direction of the flat pipes matches with a vertical direction.

Advantageous Effects of Invention

With the heat exchanger and the refrigeration cycle apparatus according to an embodiment of the present invention, the heat exchange members can be made less liable to be bent, and hence the strength of the heat exchange members can be increased.

DESCRIPTION OF EMBODIMENTS

Now, embodiments of the present invention are described with reference to the accompanying drawings.

First Embodiment

Figure 1:
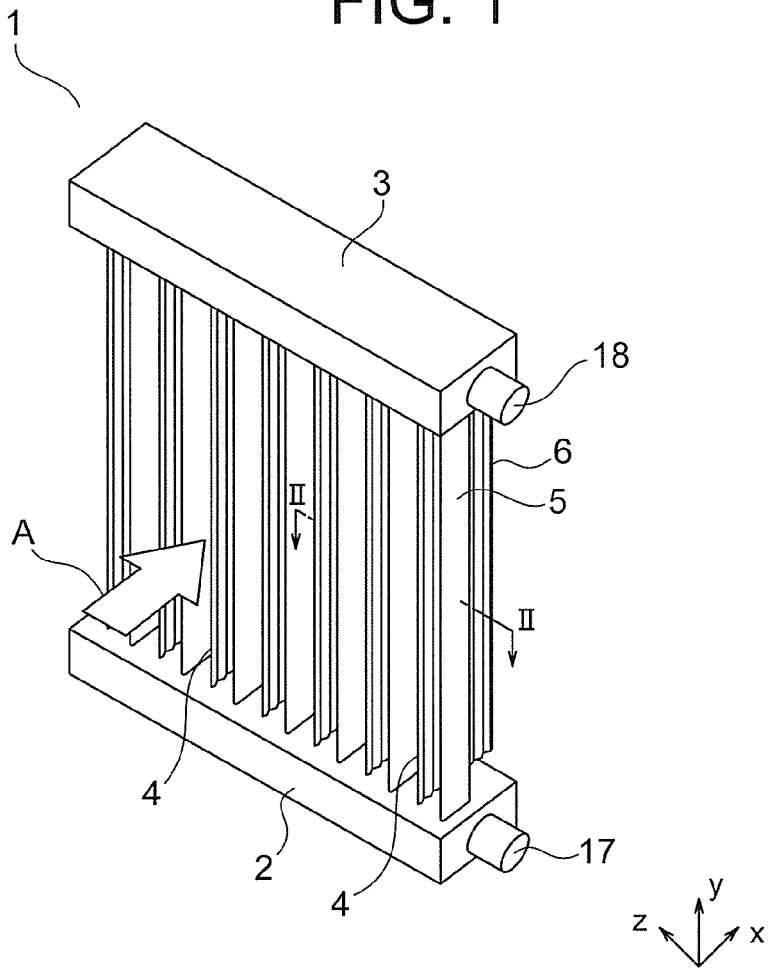
FIG. 1 is a perspective view for illustrating a heat exchanger according to a first embodiment of the present invention.
Figure 2:
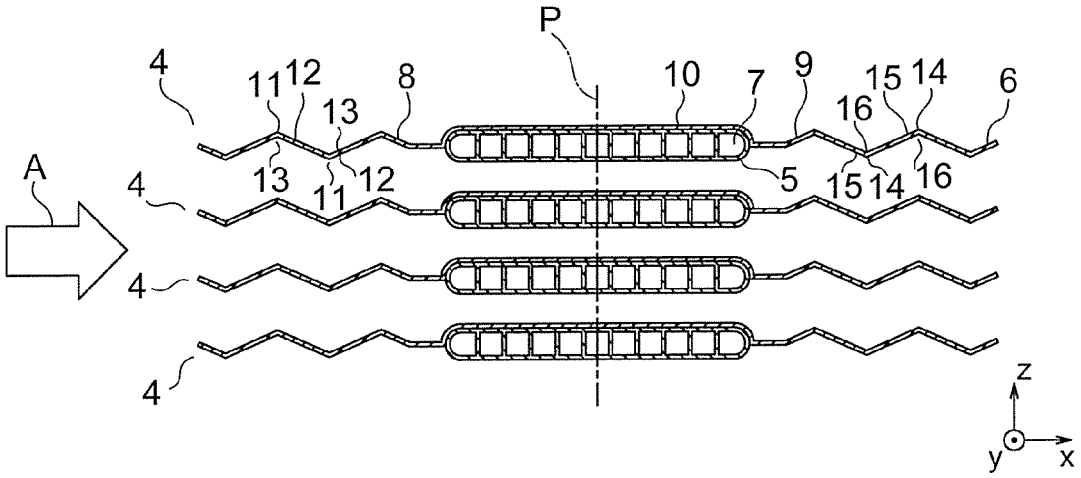
FIG. 2 is a sectional view taken along the line II-II of FIG. 1.

FIG. 1 is a perspective view for illustrating a heat exchanger according to a first embodiment of the present invention. FIG. 2 is a sectional view taken along the line II-II of FIG. 1. In FIG. 1, a heat exchanger 1 includes a first header tank 2, a second header tank 3, and a plurality of heat exchange members 4. The second header tank 3 is arranged so as to be apart from the first header tank 2. The plurality of heat exchange members 4 are each coupled to the first header tank 2 and the second header tank 3.

The first header tank 2 and the second header tank 3 are each a hollow container extending along a first direction z in parallel to each other. The heat exchanger 1 is arranged so that the first direction z, which is a longitudinal direction of the first header tank 2 and the second header tank 3, matches with a horizontal direction. The second header tank 3 is arranged above the first header tank 2.

The plurality of heat exchange members 4 are arranged side by side between the first header tank 2 and the second header tank 3 so as to be spaced apart from each other. The plurality of heat exchange members 4 are arranged side by side in the longitudinal direction of the first header tank 2 and the second header tank 3. No component of the heat exchanger 1 is connected to opposed surfaces of two adjacent heat exchange members 4, and the opposed surfaces serve as guide surfaces extending along a longitudinal direction of the heat exchange members 4. Each of the plurality of heat exchange members 4 includes a flat pipe 5 extending from the first header tank 2 to the second header tank 3 and a heat transfer plate 6 integrated with the flat pipe 5.

Each of the flat pipes 5 is a heat transfer pipe extending along a second direction y, which intersects with the first direction z. The flat pipes 5 are arranged in parallel to each other. In this example, the second direction y, which is a longitudinal direction of the flat pipes 5, is orthogonal to the first direction z. Each of the plurality of heat exchange members 4 is arranged so that the longitudinal direction of the flat pipes 5 matches with a vertical direction. A lower end of each of the flat pipes 5 is inserted into the first header tank 2, and an upper end of each of the flat pipes 5 is inserted into the second header tank 3. A load of the second header tank 3 is supported by the plurality of heat exchange members 4.

A sectional shape of each of the flat pipes 5 taken along a plane orthogonal to the longitudinal direction of the flat pipes 5 is a flat shape along a width direction of the flat pipes 5. The width direction of the flat pipes 5 is a third direction x, which is orthogonal to the second direction y being the longitudinal direction of the flat pipes 5 and intersects with the first direction z in which the plurality of heat exchange members 4 are arranged side by side. In this example, the width direction of the flat pipes 5 is a direction orthogonal to the first direction z and the second direction y.

In each of the flat pipes 5, as illustrated in FIG. 2, there are provided a plurality of refrigerant flow passages 7 through which refrigerant serving as a working fluid flows. On a cross section of each of the flat pipes 5, the plurality of refrigerant flow passages 7 are arranged side by side from one end in the width direction of each of the flat pipes 5 to another end in the width direction.

The flat pipe 5 is made of a metal material having heat conductivity. As the material for forming the flat pipe 5, for example, aluminum, an aluminum alloy, copper, or a copper alloy is used. The flat pipe 5 is manufactured by extrusion for extruding a heated material through a hole of a die to form the cross section of the flat pipe 5. The flat pipe 5 may be manufactured by drawing for drawing a material through a hole of a die to form the cross section of the flat pipe 5.

In the heat exchanger 1, an air stream A generated by an operation of a fan (not shown) passes between the plurality of heat exchange members 4. The air stream A flows while coming into contact with the flat pipes 5 and the heat transfer plates 6. As a result, heat is exchanged between the refrigerant flowing through the plurality of refrigerant flow passages 7 and the air stream A. In this example, the air stream A flowing along the width direction of each of the flat pipes 5 passes between the plurality of heat exchange members 4.

The heat transfer plates 6 are arranged along the longitudinal direction of the flat pipes 5. The heat transfer plates 6 are members formed separately from the flat pipes 5. Further, the heat transfer plates 6 are made of a metal material having heat conductivity. As a material for forming the heat transfer plates 6, for example, aluminum, an aluminum alloy, copper, or a copper alloy is used. Each of the heat transfer plates 6 includes a first extending portion 8, a second extending portion 9, and a heat transfer plate main body portion 10. The first extending portion 8 and the second extending portion 9 extend outward in the width direction of each of the flat pipes 5 from the one end in the width direction of the flat pipes 5 and the another end in the width direction of the flat pipes 5, respectively. The heat transfer plate main body portion 10 is continuous with the first extending portion 8 and the second extending portion 9 in a state of overlapping an outer peripheral surface of the flat pipe 5.

The first extending portion 8 extends from the one end of the flat pipe 5 in the width direction of each of the flat pipes 5 toward an upstream side of the air stream A, specifically, a windward side with respect to the flat pipe 5. Further, the first extending portion 8 has one or more heat transfer plate bent portions 12, each having a ridgeline 11 extending along the longitudinal direction of the flat pipes 5. The first extending portion 8 has grooves 13 extending along the longitudinal direction of the flat pipes 5, which are respectively formed by the heat transfer plate bent portions 12. In this example, a plurality of heat transfer plate bent portions 12 are continuous in the width direction of each of the flat pipes 5 while alternately changing bent directions. With the arrangement described above, the first extending portion 8 has a corrugated plate shape.

The second extending portion 9 extends from the one end of the flat pipe 5 in the width direction of each of the flat pipes 5 to a downstream side of the air stream A, specifically, a leeward side with respect to the flat pipe 5. The second extending portion 9 has one or more heat transfer plate bent portions 15, each having a ridgeline 14 extending along the longitudinal direction of the flat pipes 5. The second extending portion 9 has grooves 16 extending along the longitudinal direction of the flat pipes 5, which are respectively formed by the heat transfer plate bent portions 15. In this example, a plurality of heat transfer plate bent portions 15 are continuous in the width direction of each of the flat pipes 5 while alternately changing bent directions. With the arrangement described above, the second extending portion 9 has a corrugated plate shape.

In the heat exchanger 1, each of the first extending portions 8 has the heat transfer plate bent portions 12, and the second extending portion 9 has the heat transfer plate bent portions 15. Thus, strength of each of the heat exchange members 4 is improved against a force in a thickness direction of each of the flat pipes 5, and hence each of the heat exchange members 4 is less liable to be bent. As a result, even when the heat exchange members 4 bear a load of the second header tank 3, the heat exchange members 4 are less liable to be deformed.

The heat transfer plate main body portion 10 is arranged so as to extend from the one end of the flat pipe 5 in the width direction to the another end in the width direction along the outer peripheral surface of the flat pipe 5. Further, the heat transfer plate main body portion 10 is fixed to the flat pipe 5 through intermediation of a brazing filler metal having heat conductivity. The heat exchanger 1 is manufactured by heating an assembled body including the first header tank 2, the second header tank 3, the flat pipes 5, and the heat transfer plates 6 in a furnace. A surface of each of the flat pipes 5 and a surface of each of the heat transfer plates 6 are covered in advance with the brazing filler metal. The flat pipes 5, the heat transfer plates 6, the first header tank 2, and the second header tank 3 are fixed together with the brazing filler metal, which is molten by heating in the furnace. In this example, only part of the surface of each of the heat transfer plates 6, specifically, a surface of the heat transfer main body portion 10, which is located on a side held in contact with the flat pipe 5, is covered with the brazing filler metal.

When each of the heat exchange members 4 is viewed along the width direction of each of the flat pipes 5, the first extending portion 8 and the second extending portion 9 are located to fall within a region of the flat pipe 5. Specifically, a dimension of the first extending portion 8 and a dimension of the second extending portion 9 are equal to or smaller than a dimension of the flat pipe 5 in the thickness direction of each of the flat pipes 5. Further, when each of the heat exchanger members 4 is viewed along the longitudinal direction of the flat pipes 5, the heat exchange member 4 has a shape in line symmetry, specifically, a shape of being symmetric with respect to a straight line P orthogonal to the width direction of the flat pipes 5.

As illustrated in FIG. 1, a first refrigerant port 17 is formed at an end of the first header tank 2 in the longitudinal direction. A second refrigerant port 18 is formed at an end of the second header tank 3 in the longitudinal direction.

Next, an operation of the heat exchanger 1 is described. The air stream A generated by the operation of the fan (not shown) flows between the plurality of heat exchange members 4 while coming into contact with the first extending portions 8, the flat pipes 5, and the second extending portions 9 in the stated order. During the flow, the air stream A meanders along the heat transfer plate bent portions 12 of the first extending portion 8 and the heat transfer plate bent portions 15 of the second extending portion 9.

When the heat exchanger 1 functions as an evaporator, a gas-liquid refrigerant mixture flows from the first refrigerant port 17 into the first header tank 2. After that, the gas-liquid refrigerant mixture is distributed to the refrigerant flow passages 7 in each of the flat pipes 5 from the first header tank 2 to flow through the refrigerant flow passages 7 toward the second header tank 3.

When the gas-liquid refrigerant mixture flows through the refrigerant flow passages 7, heat is exchanged between the air stream A, which passes between the plurality of heat exchange members 4, and the refrigerant. A liquid refrigerant in the gas-liquid refrigerant mixture takes heat from the air stream A and evaporates. After that, the refrigerant having flowed from the flat pipes 5 join together in the second header tank 3, and the refrigerant flows out from the second header tank 3 to the second refrigerant port 18. When condensed water adheres to surfaces of the heat exchange members 4, the condensed water flows downward along the guide surfaces and the grooves 13 and 16 of the heat exchange members 4 by its own weight, and the condensed water is drained from the surfaces of the heat exchange members 4.

When the heat exchanger 1 functions as a condenser, a gas refrigerant flows from the second refrigerant port 18 into the second header tank 3. After that, the gas refrigerant is distributed to the refrigerant flow passages 7 in each of the flat pipes 5 from the second header tank 3 to flow through the refrigerant flow passages 7 toward the first header tank 2.

When the gas refrigerant flows through the refrigerant flow passages 7, heat is exchanged between the air stream A, which passes between the plurality of heat exchange members 4, and the refrigerant. The gas refrigerant transfers heat to the air stream A and condenses. After that, the refrigerant having flowed from the flat pipes 5 join together in the first heat tank 2, and the refrigerant flows out from the first header tank 2 to the first refrigerant port 17.

In the heat exchanger 1 described above, the first extending portion 8 extends outward in the width direction of each of the flat pipes 5 from the one end of the flat pipe 5 in the width direction, and the second extending portion 9 extends outward in the width direction of each of the flat pipes 5 from the another end of the flat pipe 5 in the width direction. The first extending portion 8 has the heat transfer plate bent portions 12 for forming the grooves 13 along the longitudinal direction of the flat pipes 5, and the second extending portion 9 has the heat transfer plate bent portions 15 for forming the grooves 16 along the longitudinal direction of the flat pipes 5. Thus, strength of each of the heat exchange members 4 can be improved against a force received on a side of the flat pipe 5, in particular, a force in the thickness direction of each of the flat pipes 5. As a result, the heat exchange members 4 can be made less liable to be bent, and hence the load of the second header tank 3 can be stably supported by the heat exchange members 4. With the configuration described above, for example, when the heat exchanger 1 is manufactured and installed, the deformation of the heat exchange members 4 can be prevented. Further, the air stream A can be caused to meander along the first extending portions 8 and the second extending portions 9. Thus, a heat transfer area of the first extending portions 8 and the second extending portions 9 can be increased, and hence improvement of heat transfer performance at the first extending portions 8 and the second extending portions 9 can be achieved.

Further, the heat exchanger 1 is arranged so that the longitudinal direction of the flat pipes 5 matches with the vertical direction. Thus, water adhering to the first extending portions 8 and the second extending portions 9 can be guided downward along the grooves 13 and 16. Thus, the grooves 13 and 16 can be made to function as drainage passages. With the function described above, during an operation in which water may adhere to the surfaces of the heat exchange members 4, for example, during an operation in which the heat exchanger 1 functions as an evaporator and during a defrosting operation to be performed after the heat exchange members 4 are frosted, drainage performance for the water adhering to the first extending portions 8 and the second extending portions 9 can be improved. Thus, degradation in heat exchange performance at the heat exchange members 4 can be suppressed.

Further, the heat transfer plate main body portion 10 of the heat transfer plate 6 is fixed to the outer peripheral surface of the flat pipe 5 through intermediation of the brazing filler metal. Thus, the heat transfer plate 6 and the flat pipe 5 can be manufactured separately from each other, and hence the heat exchange member 4 having a complicated shape formed by a combination of the heat transfer plate 6 and the flat pipe 5 can easily be manufactured. Further, when only the heat transfer plate main body portion 10 is covered with the brazing filler metal, melt of the heat transfer plate 6, which may be caused by the presence of an excessive amount of the brazing filler metal during heating in the furnace, can be prevented. Further, degradation in heat conduction performance between the flat pipe 5 and the heat transfer plate 6 can also be suppressed with use of the brazing filler metal.

Further, when each of the heat exchange members 4 is viewed along the width direction of each of the flat pipes 5, the first extending portion 8 and the second extending portion 9 are located to fall within the region of the flat pipe 5. Thus, the air stream A passing between the plurality of heat exchange members 4 becomes less liable to be subjected to resistance from the first extending portion 8 and the second extending portion 9. As a result, the air stream can easily flow between the plurality of heat exchange members 4, and hence the heat exchange performance at the heat exchange members 4 can be improved.

Further, when each of the heat exchange members 4 is viewed along the longitudinal direction of the flat pipes 5, the heat exchange member 4 has the shape of being symmetric with respect to the straight line P orthogonal to the width direction of each of the flat pipes 5. Thus, the flat pipes 5 and the heat transfer plates 6 can easily be formed. Horizontal orientations of each of the flat pipe 5 and the heat transfer pipe 6 are not required to be controlled during the manufacture of the heat exchange members 4. Thus, an error at the time of mass-production of the heat exchangers 1 can be made less liable to occur.

Second Embodiment

Figure 3:
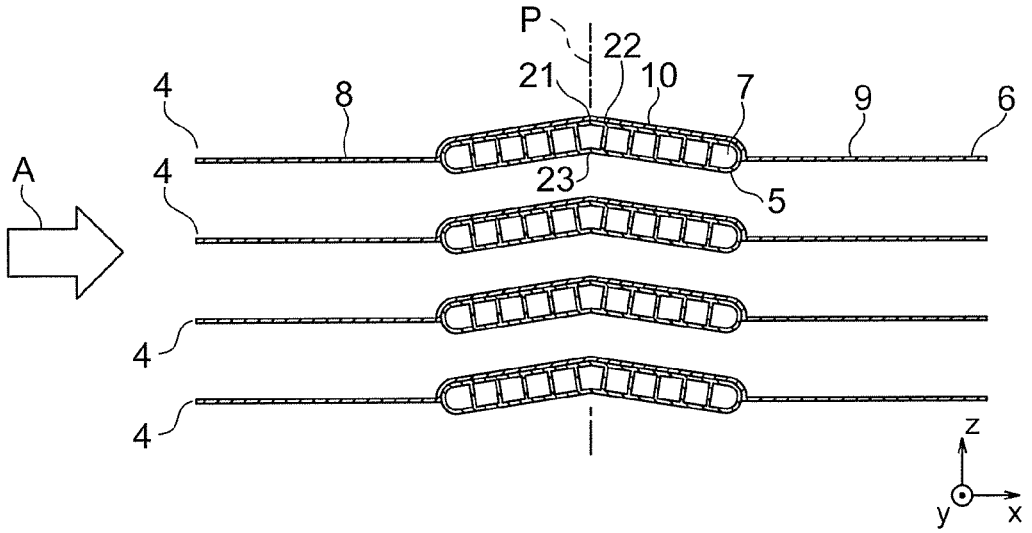
FIG. 3 is a sectional view for illustrating heat exchange members of a heat exchanger according to a second embodiment of the present invention.

FIG. 3 is a sectional view for illustrating heat exchange members of a heat exchanger according to a second embodiment of the present invention. FIG. 3 corresponds to FIG. 2 in the first embodiment. In this embodiment, each of the first extending portion 8 and the second extending portion 9 has a flat plate. Each of the first extending portion 8 and the second extending portion 9 is arranged along the longitudinal direction of the flat pipes 5 and the width direction of each of the flat pipes 5.

The flat pipe 5 has one or more flat pipe bent portions 22, each having a ridgeline 21 extending along the longitudinal direction of the flat pipes 5. The flat pipe 5 has a groove 23 extending along the longitudinal direction of the flat pipes 5, which is formed by the flat pipe bent portion 22. A sectional shape of the flat pipe 5 is such that a plurality of inclined portions with respect to the width direction of each of the flat pipes 5 are continuous in the width direction of each of the flat pipes 5. In this example, one flat pipe bent portion 22 is formed at a center of the flat pipe 5 in the width direction. The heat transfer plate main body portion 10 is arranged so as to be bent along the outer peripheral surface of the flat pipe 5. Other configurations are the same as those of the first embodiment.

In the heat exchanger 1 described above, the flat pipe 5 has the flat pipe bent portion 22 for forming the groove 23 extending along the longitudinal direction of the flat pipes 5. Thus, similarly to the first embodiment, the strength of each of the heat exchange members 4 can be improved against a force received on the side of the flat pipe 5, in particular, a force in the thickness direction orthogonal to the width direction of the flat pipes 5. Thus, the heat exchange members 4 can be made less liable to be bent, and hence, for example, when the heat exchanger 1 is manufactured and installed, the deformation of the heat exchange members 4 can be prevented. Further, the air stream A can be caused to meander along the flat pipe 5. Thus, a heat transfer area of the flat pipe 5 can be increased, and hence improvement of heat transfer performance at the flat pipe 5 can be achieved.

Further, the heat exchanger 1 is arranged so that the longitudinal direction of the flat pipes 5 matches with the vertical direction. Thus, water adhering to the flat pipe 5 can be guided downward along the grooves 23. Thus, the grooves 23 can be made to function as drainage passages. With the function described above, during an operation in which water may adhere to the surfaces of the heat exchange members 4, for example, during an operation in which the heat exchanger 1 functions as an evaporator and during a defrosting operation to be performed after the heat exchange members 4 are frosted, drainage performance for the water adhering to the flat pipe 5 can be improved. Thus, degradation in heat exchange performance at the heat exchange members 4 can be suppressed.

In the example described above, the flat pipe 5 has one flat pipe bent portion 22. However, the flat pipe 5 may have a plurality of flat pipe bent portions 22. In this case, the flat pipe 5 has a plurality of flat pipe bent portions 22, which are formed so as to be continuous in the width direction of the flat pipes 5 while alternately changing bent directions. In this case, each of the flat pipes 5 has a corrugated plate shape.

Third Embodiment

Figure 4:
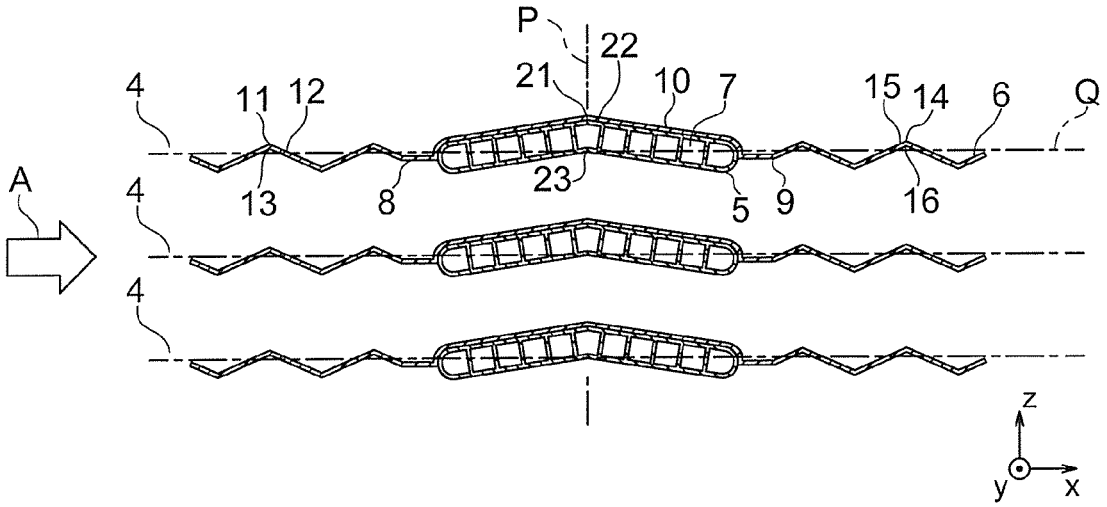
FIG. 4 is a sectional view for illustrating heat exchange members of a heat exchanger according to a third embodiment of the present invention.

FIG. 4 is a sectional view for illustrating heat exchange members of a heat exchanger according to a third embodiment of the present invention. FIG. 4 corresponds to FIG. 2 in the first embodiment. In this embodiment, the flat pipe 5 has one or more flat pipe bent portions 22. Moreover, the first extending portion 8 has one or more heat transfer plate bent portions 12, and the second extending portion 9 has one or more heat transfer plate bent portions 15. Specifically, in this embodiment, each of the heat exchange members 4 has a combination of the configuration of the first extending portion 8 and the second extending portion 9 according to the first embodiment and the configuration of the flat pipe 5 and the heat transfer plate main body portion 10 according to the second embodiment.

Each of the heat exchange members 4 has a center line Q along the width direction of the flat pipes 5. The center lines Q of the heat exchange members 4 are parallel to each other. In this example, the center line Q of each of the heat exchange members 4 is a straight line along the third direction x, which is a flow direction of the air stream A.

When each of the heat exchange members 4 is viewed along the longitudinal direction of the flat pipes 5, the first extending portion 8, the flat pipe 5, and the second extending portion 9 are continuous on the center line Q. Further, when each of the heat exchange members 4 is viewed along the longitudinal direction of the flat pipes 5, the first extending portion 8, the flat pipe 5, and the second extending portion 9 have such shapes that a plurality of inclined portions with respect to the center line Q are continuous along the width direction of each of the flat pipes 5. Other configurations are the same as those of the first embodiment.

In the heat exchanger 1 described above, the first extending portion 8 has the heat transfer plate bent portions 12, and the second extending portion 9 has the heat transfer plate bent portions 15. Moreover, the flat pipe 5 has the flat pipe bent portion 22. Thus, the heat exchange members 4 can be made less liable to be bent. Further, the air stream A can be caused to meander along the first extending portions 8, the flat pipes 5, and the second extending portions 9. Thus, the heat transfer area can be further increased, and hence further improvement of the heat transfer performance of the heat exchange members 4 can be achieved. Further, when each of the heat exchange members 4 is viewed along the longitudinal direction of the flat pipes 5, the first extending portion 8, the flat pipe 5, and the second extending portion 9 are continuous on the center line Q. Thus, increase in airflow resistance due to the presence of the heat transfer plate bent portions 12 and 15 and the flat pipe bent portion 22 can be suppressed. Hence, increase in power for the fan and reduction in airflow rate can be suppressed.

In the first embodiment and the third embodiment, an outer end of the first extending portion 8 and an outer end of the second extending portion 9 are inclined with respect to the width direction of each of the flat pipes 5. However, when each of the heat exchange members 4 is viewed along the longitudinal direction of the flat pipes 5, the outer end of the first extending portion 8 and the outer end of the second extending portion 9 may be arranged along the width direction of each of the flat pipes 5. With the arrangement described above, the first extending portion 8, the second extending portion 9, and the heat transfer plate main body portion 10 can be processed under a state in which the outer ends of the heat transfer plate 6 are fixed. Thus, the heat transfer plates 6 can easily be manufactured.

Fourth Embodiment

Figure 5:
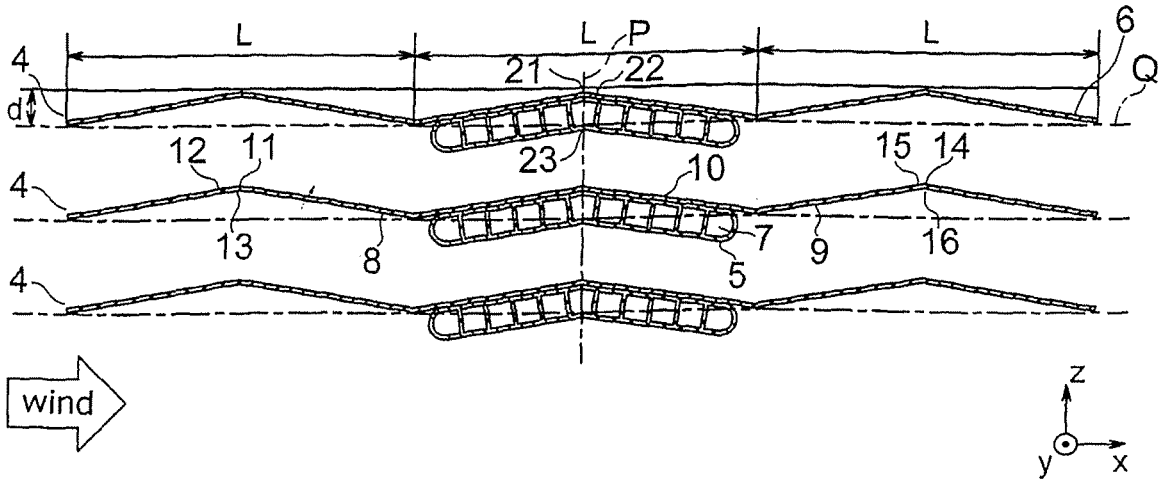
FIG. 5 is a sectional view for illustrating heat exchange members of a heat exchanger according to a fourth embodiment of the present invention.

FIG. 5 is a sectional view for illustrating heat exchange members of a heat exchanger according to a fourth embodiment of the present invention. FIG. 5 corresponds to FIG. 2 in the first embodiment. In this embodiment, the flat pipe bent portion 22 of the flat pipe 5, the heat transfer plate bent portion 12 of the first extending portion 8, and the heat transfer plate bent portion 15 of the second extending portion 9 are continuous at equal pitches in the width direction of each of the flat pipes 5. With the configuration described above, the plurality of grooves 13, 16, and 23 respectively formed by the heat transfer bent portion 12, the heat transfer bent portion 15, and the flat pipe bent portion 22 are continuous in the width direction of each of the flat pipes 5, and the plurality of grooves 13, 16, and 23 are equally apart from each other. Specifically, when each of the heat exchange members 4 is viewed along the longitudinal direction of the flat pipes 5, the heat exchange member 4 has a corrugates shape formed by the heat transfer plate bent portions 12 and 15 and the flat pipe bent portion 22. A corrugation length L of the corrugated shape of the heat exchange member 4 is set to be the same for the first extending portion 8, the flat pipe 5, and the second extending portion 9.

Further, depths of the plurality of grooves 13, 16, and 23 respectively formed by the heat transfer plate bent portion 12, 15, and the flat pipe bent portion 22 are set equal to each other. Specifically, when each of the heat exchange members 4 is viewed along the longitudinal direction of the flat pipes 5, the heat exchange member 4 has a corrugates shape formed by the heat transfer plate bent portions 12 and 15 and the flat pipe bent portion 22. A corrugation depth d of the corrugated shape of the heat exchange member 4 is set to be the same for the first extending portion 8, the flat pipe 5, and the second extending portion 9. Other configurations are the same as those of the third embodiment.

In the heat exchanger 1 described above, the plurality of grooves 13, 16, and 23 respectively formed by the heat transfer plate bent portion 12, the heat transfer plate bent portion 15, and the flat pipe bent portion 22 are equally apart from each other, and the depths of the plurality of grooves 13, 16, and 23 are set equal to each other. Thus, the heat transfer plate bent portion 12, the heat transfer plate bent portion 15, and the flat pipe bent portion 22 can be formed to have a regular shape pattern. With the shapes described above, formation work for the flat pipes 5 and the heat transfer pipes 6 can easily be performed, and hence the heat exchange members 4 can easily be manufactured.

In the first embodiment, the third embodiment, and the fourth embodiment, the sectional shape of each of the heat exchange members 4 is the same at any position in the longitudinal direction of the flat pipes 5. However, the sectional shape of the heat exchange member 4 is not limited thereto. For example, the heat exchange member 4 may have a reinforced section and non-reinforced sections in the longitudinal direction of the flat pipes 5. In the reinforced section and the non-reinforced sections, only the first extending portion 8 and the second extending portion 9 in the reinforced section may have the heat transfer plate bent portion 12 and the heat transfer plate bent portion 15, respectively. In this example, the shape of the first extending portion 8 and the shape of the second extending portion 9 in the non-reinforced section are flat plate shapes. Further, in this case, the non-reinforced sections are set at both ends of the heat exchange member 4 in the longitudinal direction, which are to be inserted into the first header tank 2 and the second header tank 3, and the reinforced section is set between the two non-reinforced sections. In this manner, a shape of each of insertion holes for the heat exchange members 4, which are formed in the first header tank 2 and the second header tank 3, can be simplified. Thus, the first header tank 2 and the second header tank 3 can easily be manufactured.

Fifth Embodiment

Figure 6:
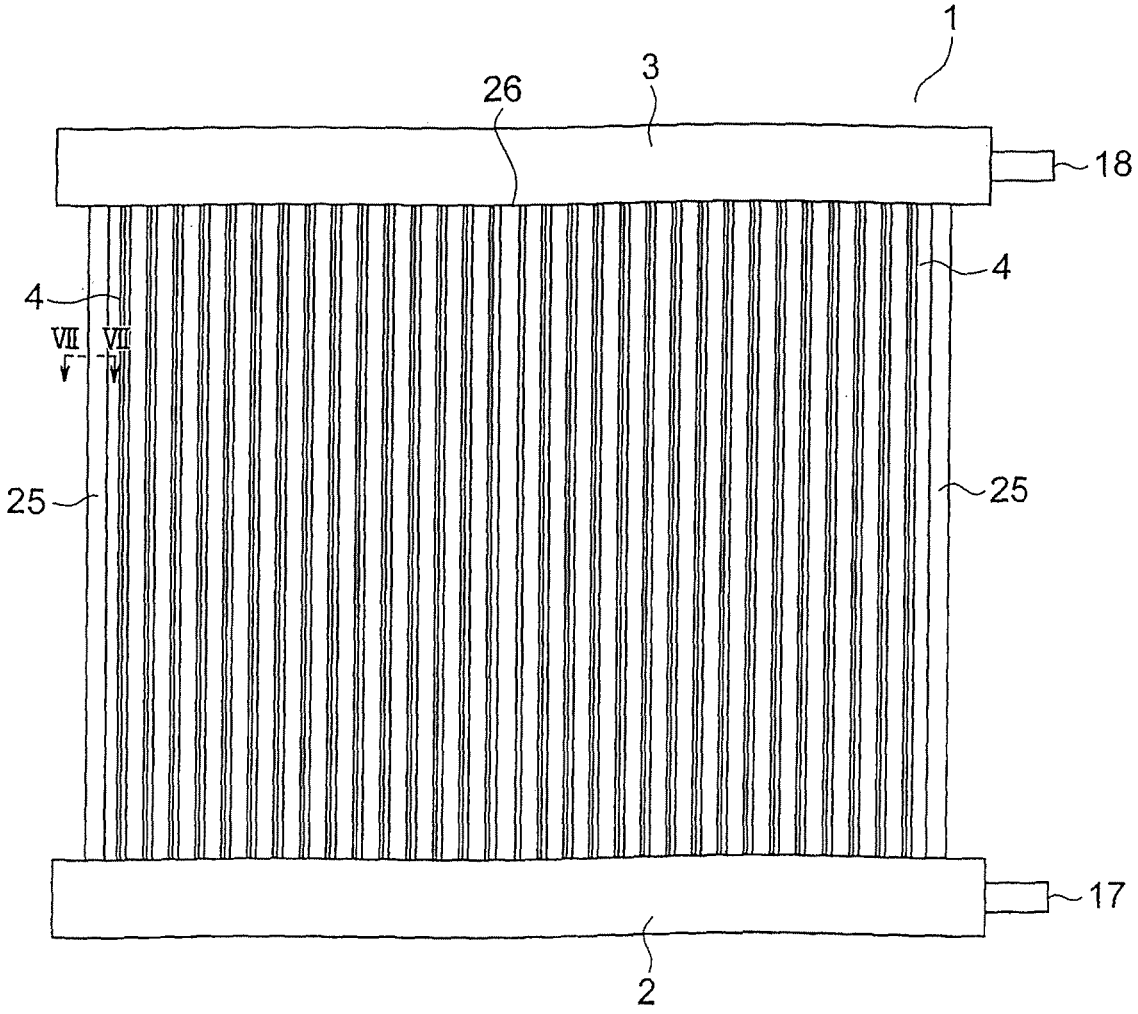
FIG. 6 is a side view for illustrating a heat exchanger according to a fifth embodiment of the present invention.

FIG. 6 is a side view for illustrating the heat exchanger 1 according to a fifth embodiment of the present invention. The heat exchanger 1 includes the first header tank 2, the second header tank 3, the plurality of heat exchange members 4, and a plurality of reinforcing members 25 and 26. Configurations of the first header tank 2, the second header tank 3, and the plurality of heat exchange members 4 are the same as those of the first embodiment.

A pair of the first reinforcing members 25 and the second reinforcing member 26 are arranged as the plurality of reinforcing members 25 and 26 between the first header tank 2 and the second header tank 3. The pair of first reinforcing members 25 and the second reinforcing member 26 are arranged at positions different from positions of the plurality of heat exchange members 4. Further, the pair of first reinforcing members 25 and the second reinforcing member 26 are arranged along the longitudinal direction of the flat pipes 5, and are coupled to each of the first header tank 2 and the second header tank 3.

The pair of first reinforcing members 25 are arranged so as to be apart from each other in the first direction z, which is the direction in which the plurality of heat exchange members 4 are arranged side by side. The plurality of heat exchange members 4 are arranged between the pair of first reinforcing members 25. The second reinforcing member 26 is arranged at an intermediate position between the pair of first reinforcing members 25 in the first direction z.

The pair of first reinforcing members 25 and the second reinforcing member 26 are less liable to be bent than the heat exchange members 4. As a material for forming each of the pair of reinforcing members 25 and the second reinforcing member 26, the same material as that used for the first header tank 2, the second header tank 3, and the plurality of heat exchange members 4 is used. With use of the material described above, corrosion of the first header tank 2, the second header tank 3, and the plurality of heat exchange members 4 can be prevented.

Figure 7:
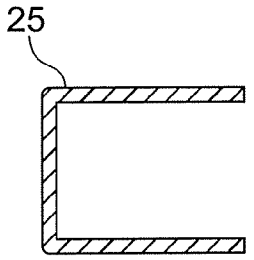
FIG. 7 is a sectional view taken along the line VII-VII of FIG. 6.

FIG. 7 is a sectional view taken along the line VII-VII of FIG. 6. Each of the first reinforcing members 25 has a U-like sectional shape. In this example, each of the first reinforcing members 25 is arranged so that an open part of the U-like sectional shape is oriented toward the heat exchange members 4. The second reinforcing member 26 has a flat plate shape. In this example, a direction in which the plurality of heat exchange members 4 are arranged side by side matches with a width direction of the second reinforcing member 26. Other configurations are the same as those of the first embodiment.

In the heat exchanger 1 described above, the plurality of reinforcing members 25 and 26, which are coupled to the first header tank 2 and the second header tank 3, are arranged at the positions different from the positions of the plurality of heat exchange members 4. Thus, part of the load of the second header tank 3 can be supported by the plurality of reinforcing members 25 and 26, and hence each of the heat exchange members 4 can be made further less liable to be bent. In this manner, the deformation of the heat exchange members 4 can be more reliably prevented.

Further, in the example described above, each of the first reinforcing members 25 has the U-like sectional shape, and the second reinforcing member 26 has the flat plate shape. However, the shapes of the first reinforcing members 25 and the second reinforcing member 26 are not limited thereto. Each of the first reinforcing members 25 and the second reinforcing member 26 may have any shape as long as each of the first reinforcing members 25 and the second reinforcing member 26 are less liable to be bent than the heat exchange members 4. For example, the first reinforcing members 25 and the second reinforcing member 26 may each have a U-like sectional shape.

Further, in the example described above, the pair of first reinforcing members 25 and the second reinforcing member 26 are applied to the heat exchanger 1 according to the first embodiment. However, the pair of first reinforcing members 25 and the second reinforcing member 26 may be applied to the heat exchangers 1 according to the second to fourth embodiments.

Further, in the example described above, the pair of first reinforcing members 25 and the second reinforcing member 26 are arranged between the first header tank 2 and the second header tank 3. However, the second reinforcing member 26 may be omitted as long as the deformation of the heat exchange members 4 can be prevented by the pair of first reinforcing members 25.

Sixth Embodiment

Figure 8:
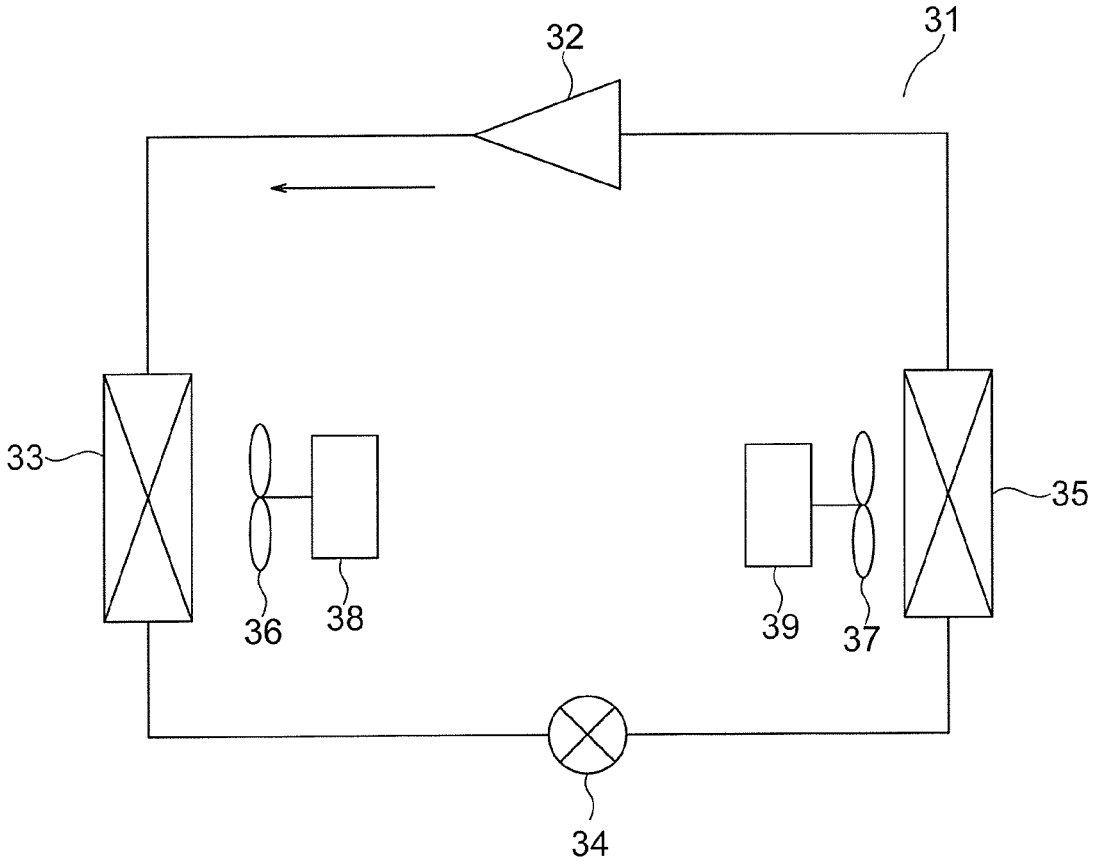
FIG. 8 is a configuration diagram for illustrating a refrigeration cycle apparatus according to a sixth embodiment of the present invention.

FIG. 8 is a configuration diagram for illustrating a refrigeration cycle apparatus according to a sixth embodiment of the present invention. A refrigeration cycle apparatus 31 includes a refrigeration cycle circuit including a compressor 32, a condensing heat exchanger 33, an expansion valve 34, and an evaporating heat exchanger 35. In the refrigeration cycle apparatus 31, a refrigeration cycle is carried out by drive of the compressor 32. In the refrigeration cycle, the refrigerant circulates through the compressor 32, the condensing heat exchanger 33, the expansion valve 34, and the evaporating heat exchanger 35 while changing a phase. In this embodiment, the refrigerant circulating through the refrigeration cycle circuit flows in a direction indicated by the arrow in FIG. 8.

The refrigeration cycle apparatus 31 includes fans 36 and 37 and drive motors 38 and 39. The fans 36 and 37 individually send air streams to the condensing heat exchanger 33 and the evaporating heat exchanger 35, respectively. The drive motors 38 and 39 are configured to individually rotate the fans 36 and 37, respectively. The condensing heat exchanger 33 exchanges heat between the air stream generated by an operation of the fan 36 and the refrigerant. The evaporating heat exchange 35 exchanges heat between the air stream generated by an operation of the fan 37 and the refrigerant.

The refrigerant is compressed in the compressor 2 and is sent to the condensing heat exchanger 33. In the condensing heat exchanger 33, the refrigerant transfers heat to an outside air and condenses. After that, the refrigerant is sent to the expansion valve 34. After being decompressed by the expansion valve 34, the refrigerant is sent to the evaporating heat exchanger 35. After that, the refrigerant takes heat from the outside air in the evaporating heat exchanger 35 and evaporates. Then, the refrigerant returns to the compressor 32.

In this embodiment, the heat exchanger 1 according to any one of the first to fifth embodiments is used for one or both of the condensing heat exchanger 33 and the evaporating heat exchanger 35. With use of the heat exchanger 1, the refrigeration cycle apparatus having high energy efficiency can be achieved. Further, in this embodiment, the condensing heat exchanger 33 is used as an indoor heat exchanger, and the evaporating heat exchanger 35 is used as an outdoor heat exchanger. The evaporating heat exchanger 35 may be used as an indoor heat exchanger, and the condensing heat exchanger 33 may be used as an outdoor heat exchanger.

In this case, a heating energy efficiency given when the condensing heat exchanger 33 is used as an indoor heat exchanger is expressed by the following expression.

$$\text{Heating Energy Efficiency} = \text{Condensing Heat Exchanger(Indoor Heat Exchanger)Capacity} / \text{Total Input} \quad (1)$$

Further, a heating energy efficiency given when the evaporating heat exchanger 35 is used as an indoor heat exchanger is expressed by the following expression.

$$\text{Cooling Energy Efficiency} = \text{Evaporating Heat Exchanger(Indoor Heat Exchanger)Capacity} / \text{Total Input} \quad (2)$$

Seventh Embodiment

Figure 9:
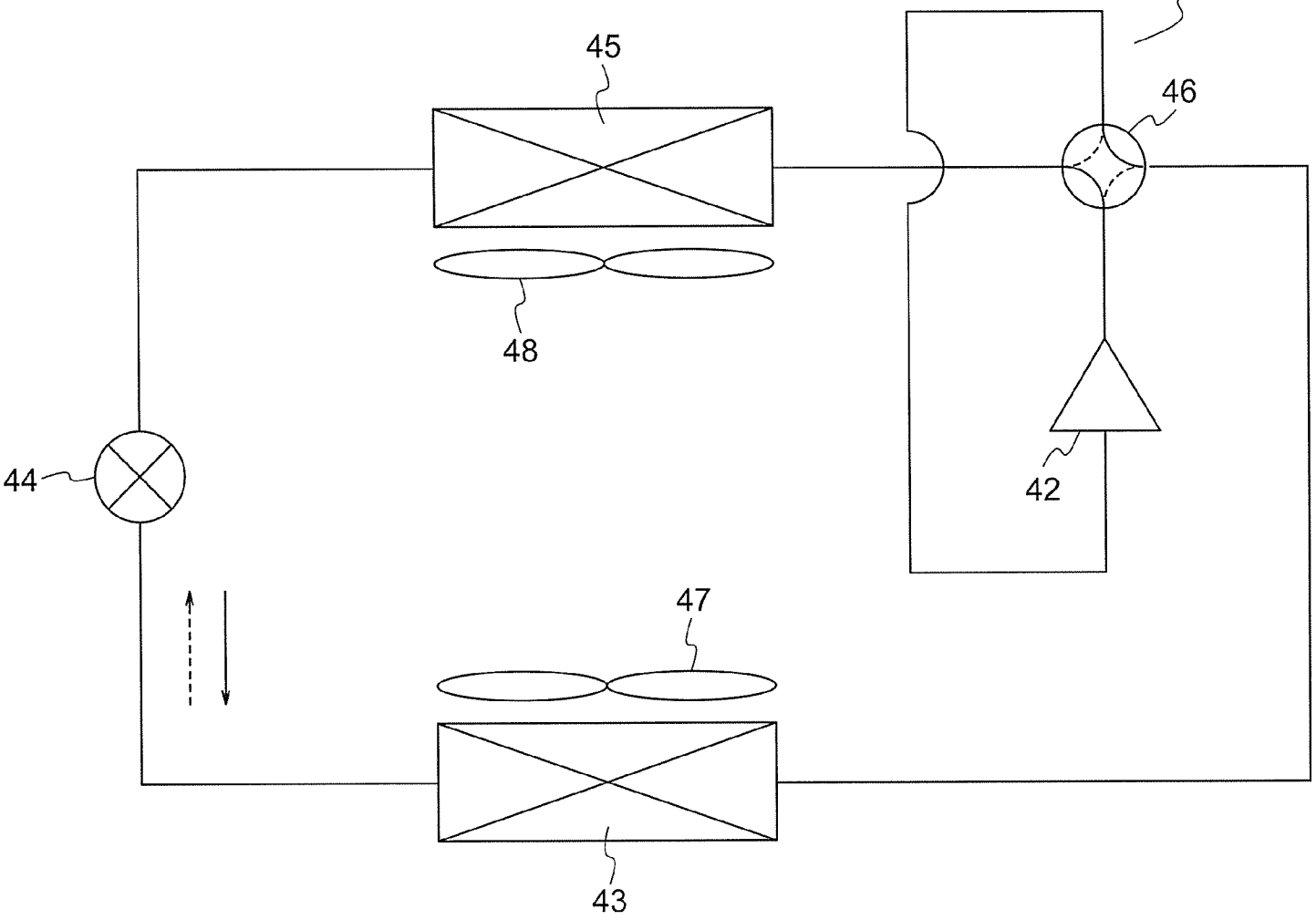
FIG. 9 is a configuration diagram for illustrating a refrigeration cycle apparatus according to a seventh embodiment of the present invention.

FIG. 9 is a configuration diagram for illustrating a refrigeration cycle apparatus according to a seventh embodiment of the present invention. A refrigeration cycle apparatus 41 includes a refrigeration cycle circuit including a compressor 42, an outdoor heat exchanger 43, an expansion valve 44, and an indoor heat exchanger 45. In the refrigeration cycle apparatus 41, a refrigeration cycle is carried out by drive of the compressor 42. In the refrigeration cycle, the refrigerant circulates through the compressor 42, the outdoor heat exchanger 43, the expansion valve 44, and the indoor heat exchanger 45 while changing a phase. In this embodiment, the compressor 42, the outdoor heat exchanger 43, the expansion valve 44, and a four-way valve 46 are provided to an outdoor unit, and the indoor heat exchanger 45 is provided to an indoor unit.

An outdoor fan 47 configured to force the outdoor air to pass through the outdoor heat exchanger 43 is provided to the outdoor unit. The outdoor heat exchanger 43 exchanges heat between an air stream of the outdoor air, which is generated by an operation of the outdoor fan 47, and the refrigerant. An indoor fan 48 configured to force the indoor air to pass through the indoor heat exchanger 45 is provided to the indoor unit. The indoor heat exchanger 45 exchanges heat between an air stream of the indoor air, which is generated by an operation of the indoor fan 48, and the refrigerant.

An operation of the refrigeration cycle apparatus 41 can be switched between a cooling operation and a heating operation. The four-way valve 46 is an electromagnetic valve configured to switch a refrigerant flow passage in accordance with the switching of the operation of the refrigeration cycle apparatus 1 between the cooling operation and the heating operation. The four-way valve 46 guides the refrigerant from the compressor 42 to the outdoor heat exchanger 43 and the refrigerant from the indoor heat exchanger 45 to the compressor 42 during the cooling operation, and guides the refrigerant from the compressor 42 to the indoor heat exchanger 45 and the refrigerant from the outdoor heat exchanger 43 to the compressor 42 during the heating operation. In FIG. 9, a direction of flow of the refrigerant during the cooling operation is indicated by the broken-line arrow, and a direction of flow of the refrigerant during the heating operation is indicated by the solid-line arrow.

During the cooling operation of the refrigeration cycle apparatus 41, the refrigerant, which has been compressed in the compressor 42, is sent to the outdoor heat exchanger 43. In the outdoor heat exchanger 43, the refrigerant transfers heat to the outdoor air and condenses. After that, the refrigerant is sent to the expansion valve 44. After being decompressed by the expansion valve 44, the refrigerant is sent to the indoor heat exchanger 45. Then, after the refrigerant takes heat from an indoor air and evaporates, the refrigerant returns to the compressor 42. Thus, during the cooling operation of the refrigerant cycle device 41, the outdoor heat exchanger 43 functions as the condenser, and the indoor heat exchanger 45 functions as an evaporator.

During the heating operation of the refrigeration cycle apparatus 41, the refrigerant, which has been compressed in the compressor 42, is sent to the outdoor heat exchanger 45. In the outdoor heat exchanger 45, the refrigerant transfers heat to the indoor air and condenses. After that, the refrigerant is sent to the expansion valve 44. After being decompressed by the expansion valve 44, the refrigerant is sent to the outdoor heat exchanger 43. Then, after the refrigerant takes heat from an outdoor air and evaporates, the refrigerant returns to the compressor 42. Thus, during the heating operation of the refrigerant cycle device 41, the outdoor heat exchanger 43 functions as an evaporator, and the indoor heat exchanger 45 functions as a condenser.

In this embodiment, the heat exchanger 1 according to any one of the first to fifth embodiments is used for one or both of the outdoor heat exchanger 43 and the indoor heat exchanger 45. With use of the heat exchanger 1, the refrigeration cycle apparatus having high energy efficiency can be achieved.

The refrigeration cycle apparatus according to each of the sixth embodiment and the seventh embodiment is applied to, for example, an air conditioning apparatus or a refrigeration apparatus.

In each of the embodiments described above, each of the first extending portion 8 and the second extending portion 9 extends from the flat pipe 5. However, only the first extending portion 8 may extend from the flat pipe 5 without the formation of the second extending portion 9, or only the second extending portion 9 may extend from the flat pipe 5 without the formation of the first extending portion 8. Further, a length of the first extending portion 8 and a length of the second extending portion 9 may be set different from each other. Even in the above-mentioned manner, the heat exchange members 4 can be made less liable to be bent.

Further, in each of the embodiments described above, the flat pipe 5 and the heat transfer plate 6 are formed as separate members. However, the heat exchange member 4 including the flat pipe 5 and the heat transfer plate 6 may be formed as a single member. In this case, each of the heat exchanger members 4 is manufactured through extrusion for extruding a heated material through a hole formed in a die to simultaneously form a cross section of the flat pipe 5 and a cross section of the heat transfer plate 6. Each of the heat exchange members 4 may also be manufactured through drawing for drawing a material through a hole formed in a die to form the cross section of the flat pipe 5 and the cross section of the heat transfer plate 6.

In each of the heat exchangers 1 and the refrigeration cycle apparatus 31 and 41 according to the embodiments described above, with use of a refrigerant such as R410A, R32, or HFO1234yf, the effects of the heat exchanger 1 and the refrigeration cycle apparatus 31, 41 can be attained.

In each of the embodiments described above, the air and the refrigerant have been described as examples of the working fluid. However, the same effects may be attained even with use of other gases, liquids, and gas-liquid fluid mixtures.

The effects of the heat exchanger 1 and the refrigeration cycle apparatus 31 and 41 according to the embodiments described above can be attained for any refrigerating machine oils such as mineral oil-based ones, alkylbenzene oil-based ones, ester oil-based ones, ether oil-based ones, and fluorine oil-based ones regardless of whether or not the oil is soluble in the refrigerant.

As other examples of use of the present invention, the present invention can be used for a heat pump device, which is easy to manufacture, and is required to have improved heat exchange performance and improved energy saving performance.

REFERENCE SIGNS LIST

1 heat exchanger, 2 first header tank, 3 second header tank, 4 heat exchange member, 5 flat pipe, 6 heat transfer plate, 8 first extending portion, 9 second extending portion, 10 heat transfer plate main body portion, 12, 15 heat transfer plate bent portion, 22 flat pipe bent portion, 13, 16, 23 groove, 25 first reinforcing member, 26 second reinforcing member

The invention claimed is:

1. A heat exchanger, comprising:

a first header tank;

a second header tank arranged so as to be apart from the first header tank; and a plurality of heat exchange members, which are each coupled to the first header tank and the second header tank, and are arranged side by side between the first header tank and the second header tank, wherein each of the plurality of heat exchange members includes:

a heat transfer pipe extending from the first header tank to the second header tank; and a heat transfer plate integrated with the heat transfer pipe along a longitudinal direction of the heat transfer pipe, wherein a width direction of each of the heat transfer pipe intersects with a direction in which each of the plurality of heat exchange members are arranged side by side, wherein each of the heat transfer plates includes an extending portion extending outward in the width direction of each of the heat transfer pipes from at least one of one end of a corresponding one of the heat transfer pipes in the width direction and another end of the corresponding one of the heat transfer pipes in the width direction, wherein each of the heat transfer pipes has one or more heat transfer pipe bent portions, each forming a groove extending along the longitudinal direction of the heat transfer pipes, wherein each of the extending portions has one or more heat transfer plate bent portions, each forming a groove extending along the longitudinal direction of the heat transfer pipes, wherein each of the plurality of heat exchange members has a center line along the width direction of each of the heat transfer pipes, and wherein, when each of the plurality of heat exchange members is viewed along the longitudinal direction of the heat transfer pipes, a corresponding one of the heat transfer pipes and a corresponding one of the extending portions are continuous along the center line of the heat exchange member, wherein each of the heat transfer plates includes a heat transfer plate main body portion, which is continuous with the extending portion in a state of overlapping a corresponding heat transfer pipe of the heat transfer pipes, wherein each of the heat transfer plate main body portions is fixed to a corresponding heat transfer pipe of the heat transfer pipes through intermediation of a brazing filler metal, wherein each of the heat transfer plate main body portions overlaps only on one end surface of a corresponding heat transfer pipe of the heat transfer pipes in a thickness direction of the heat transfer pipe, and wherein a plurality of equal-depth grooves respectively formed by the heat transfer pipe bent portion and the heat transfer plate bent portion are continuous in the width direction of the heat transfer pipes, and are equally apart from each other.

2. The heat exchanger according to claim 1, wherein, when each of the plurality of heat exchange members is viewed along the width direction of each of the heat transfer pipes, the extending portion is located to fall within a region of a corresponding one of the heat transfer pipes.

3. The heat exchanger according to claim 1, wherein the extending portion extends from each of the one end of a corresponding one of the heat transfer pipes in the width direction and the another end of the corresponding one of the heat transfer pipes in the width direction, and wherein, when each of the heat exchange members is viewed along the longitudinal direction of the heat transfer pipes, the heat exchange member has a shape of being symmetric with respect to a straight line orthogonal to the width direction of each of the heat transfer pipes.

4. The heat exchanger according to claim 1, further comprising reinforcing members, which are coupled to each of the first header tank and the second header tank, and are arranged at positions different from positions of the plurality of heat exchange members, wherein the reinforcing members are less liable to be bent than the heat exchange members.

5. A refrigeration cycle apparatus, comprising:

a compressor;

an outdoor heat exchanger;

an expansion valve; and an indoor heat exchanger, wherein the outdoor heat exchanger comprises:

a first header tank;

a second header tank arranged so as to be apart from the first header tank; and a plurality of heat exchange members, which are each coupled to the first header tank and the second header tank, and are arranged side by side between the first header tank and the second header tank, wherein each of the plurality of heat exchange members includes:

a heat transfer pipe extending from the first header tank to the second header tank; and a heat transfer plate integrated with the heat transfer pipe along a longitudinal direction of the heat transfer pipe, wherein a width direction of each of the heat transfer pipes intersects with a direction in which each of the plurality of heat exchange members are arranged side by side, wherein each of the heat transfer plates includes an extending portion extending outward in the width direction of each of the heat transfer pipes from at least one of one end of a corresponding one of the heat transfer pipe in the width direction and another end of the corresponding one of the heat transfer pipes in the width direction, wherein each of the heat transfer pipes has one or more heat transfer pipe bent portions, each forming a groove extending along the longitudinal direction of the heat transfer pipes, wherein each of the extending portions has one or more heat transfer plate bent portions, each forming a groove extending along the longitudinal direction of the heat transfer pipes, wherein each of the plurality of heat exchange members has a center line along the width direction of each of the heat transfer pipes, wherein, when each of the plurality of heat exchange members is viewed along the longitudinal direction of the heat transfer pipes, a corresponding one of the heat transfer pipes and a corresponding one of the extending portions are continuous along the center line of the heat exchange member, wherein each of the heat transfer plates includes a heat transfer plate main body portion, which is continuous with the extending portion in a state of overlapping a corresponding one of the heat transfer pipes, wherein each of the heat transfer plate main body portions is fixed to a corresponding one of the heat transfer pipes through intermediation of a brazing filler metal, wherein each of the heat transfer plate main body portions overlaps only on one end surface of a corresponding one of the heat transfer pipes in a thickness direction of the heat transfer pipe, and wherein a plurality of equal-depth grooves respectively formed by the heat transfer pipe bent portion and the heat transfer plate bent portion are continuous in the width direction of the heat transfer pipes, and are equally apart from each other.

* * * * *